US012496482B2

(12) United States Patent
Wroclawsky

(10) Patent No.: US 12,496,482 B2
(45) Date of Patent: Dec. 16, 2025

(54) POWER SHORTS FOR FITNESS AND REHABILITATION

(71) Applicant: Sol Wroclawsky, Long Beach, CA (US)

(72) Inventor: Sol Wroclawsky, Long Beach, CA (US)

( * ) Notice: Subject to any disclaimer, the term of this patent is extended or adjusted under 35 U.S.C. 154(b) by 0 days.

(21) Appl. No.: 18/027,112

(22) PCT Filed: Dec. 27, 2021

(86) PCT No.: PCT/US2021/065189
§ 371 (c)(1),
(2) Date: Mar. 19, 2023

(87) PCT Pub. No.: WO2022/146906
PCT Pub. Date: Jul. 7, 2022

(65) Prior Publication Data

US 2023/0330468 A1 Oct. 19, 2023

Related U.S. Application Data

(60) Provisional application No. 63/205,581, filed on Dec. 28, 2020.

(51) Int. Cl.
*A63B 21/04* (2006.01)
*A63B 21/00* (2006.01)
(Continued)

(52) U.S. Cl.
CPC ..... *A63B 21/0421* (2013.01); *A63B 21/0555* (2013.01); *A63B 21/0557* (2013.01);
(Continued)

(58) Field of Classification Search
CPC ..... A63B 21/0421; A63B 21/0555; A63B 21/0557; A63B 21/4009; A63B 21/4011;
(Continued)

(56) References Cited

U.S. PATENT DOCUMENTS 3,435,605 A * 4/1969 Ammons ..... D02G 3/46 57/236
6,012,993 A * 1/2000 Guerriero ..... A63B 21/4001 473/424

(Continued)

*Primary Examiner* — Zachary T Moore

(57) ABSTRACT

A unitary exercise device that provides exercise of the core muscles and legs of a user over a full range of motion in performing various physical activities by providing simultaneous counter-balancing tension to the core muscles and legs of the user as he is engaged in performance of the selected physical activity. The exercise device comprises a waist loop, left and right thigh loops, left and right rear and front straps, all of which are elastic materials heat-fused or sewn together to provide an exercise device specifically designed for a specific user. When worn by a user, the elastic rear and front straps of the exercise device provide counter-balancing tension to various muscle groups and legs of the user, dependent on the physical activity being performed, which over time with repetitive use and practice will provide improved performance or rehabilitation to the user when performing subsequently without the exercise device.

7 Claims, 8 Drawing Sheets

(51) Int. Cl.
*A63B 21/055* (2006.01)
*A63B 23/035* (2006.01)
*A63B 23/04* (2006.01)

(52) U.S. Cl.
CPC ..... *A63B 21/4009* (2015.10); *A63B 21/4011* (2015.10); *A63B 23/03541* (2013.01); *A63B 23/0482* (2013.01); *A63B 2220/20* (2013.01); *A63B 2220/31* (2013.01); *A63B 2220/62* (2013.01); *A63B 2220/89* (2013.01)

(58) Field of Classification Search
CPC ..... A63B 23/03541; A63B 23/0482; A63B 2220/20; A63B 2220/31; A63B 2220/62; A63B 2220/89
See application file for complete search history.

(56) References Cited

U.S. PATENT DOCUMENTS 6,123,664 A * 9/2000 Ard ..... A63B 23/20 600/38
6,739,801 B2 * 5/2004 Dreyer ..... E02B 15/0814 405/63
7,314,437 B2 * 1/2008 Frappier ..... A63B 21/4025 482/126
7,438,653 B2 * 10/2008 Anderson ..... A63B 69/0059 473/422
RE46,069 E * 7/2016 GibsonHorn ..... A63B 21/4005
9,498,692 B2 * 11/2016 Bledsoe ..... A63B 21/0552
10,046,194 B2 * 8/2018 Celebrini ..... A63B 21/0552
10,384,094 B1 * 8/2019 Newman ..... A63B 21/0557
10,638,798 B2 * 5/2020 Glaude ..... A41C 1/12
10,842,204 B2 * 11/2020 Stricker ..... A41D 31/185
D927,072 S * 8/2021 Gehlhausen ..... D29/101.5
2011/0306479 A1 * 12/2011 Pierce ..... A63B 23/16 482/139
2015/0190669 A1 * 7/2015 Matsuura ..... A63B 21/4017 482/8
2016/0000155 A1 * 1/2016 Marecek ..... A63B 21/065 2/227
2016/0310811 A1 * 10/2016 Bledsoe ..... A63B 69/0002
2018/0318630 A1 * 11/2018 Young ..... A63B 21/0428
2019/0262161 A1 * 8/2019 Massimiani ..... A63B 71/1225

* cited by examiner

POWER SHORTS FOR FITNESS AND REHABILITATION

RELATED APPLICATION(S)

This utility patent application claims priority of U.S. Provisional Patent Application Ser. No. 63/205,581, filed on Dec. 28, 2020, entitled "THE POWER SHORTS." by inventor Sol Wroclawsky, which application is incorporated herein its entirety in this application by this reference.

BACKGROUND OF THE INVENTION

1. Field of the Invention

The invention is related generally to exercise devices utilizing elastic restraint straps and loops, and more particularly, to a unitary exercise device that provides counter-balancing resistances to exercise the core muscles and legs of a user over a full range of motion in performing various physical activities, such as running, walking, cycling, skating, skiing, and other like physical activities.

2. Related Art

Today, running is one of the most popular forms of exercise in the United States. There are many benefits of running: improving cardiovascular fitness, building up strength, endurance, and stamina, burning calories and controlling weight, etc. Running may take several forms, including jogging or steady-state running that utilizes slow twitch muscles to build endurance and aerobic fitness, and sprinting which involve anaerobic workouts that improve muscle strength as well as speed and endurance. These two forms can be combined to improve the user's performance over time to overcome plateaus or sticking points in training.

For persons less athletically inclined, advanced in age, or undergoing rehabilitation of injuries or after surgery, these persons instead of running may prefer walking, which will still provide similar benefits as running but at a different level of effort and intensity. In general, training one's body to run or walk longer or faster takes time, patience, and perseverance in that these persons should train for the long term and not physically overstrain their bodies beyond their current physical capabilities. Many runners/walkers may hit an early plateau in their training plans or may suffer burnout, fatigue, or simply lose interest in any further training if they try to progress too rapidly.

Accordingly, many varieties of devices and apparatus have been developed to aid persons engaged in running, walking, bicycling, etc., or for that matter, any physical activity that utilizes large muscle groups such as core muscles and legs in a coordinated, repetitive cyclic pattern. Many of these apparatus and devices utilize resistance bands or elastic restraint straps to apply resistance to the core muscles or legs of the user while exercising. For example, a leg muscle training device comprising an elongated elastomeric and stretchable tether and a set of leg binders attached to each end of the tether is disclosed in U.S. Pat. No. 5,167,601 to Frappier, entitled Sprinter Leg Muscle Training Device and Method. In Frappier, stationary resistance is provided to a runner by a personal trainer firmly grasping one end of the tether or attaching it to a point of attachment. Polyurethane surgical tubing may be used for the tether.

There are also numerous apparatus utilizing treadmills with resistance bands or elastic restraint straps. For example, a treadmill with a frame connected at a rearward end of the treadmill wherein a resistance attachment having an end connected to a human body is affixed to the frame of the treadmill so as to exert a resistance force on the human body is disclosed in U.S. Pat. No. 6,123,649 to Lee et al., entitled Resistance Application for Connection to a Human Body. Another example of an apparatus utilizing a treadmill is found in U.S. Pat. No. 6,652,427 to Wroclawsky, entitled Treadmill Resistance Apparatus, which discloses an apparatus for use with a treadmill for exercising the legs and lower body of a user with an elastomeric member that attaches to the user.

Another common type of exercise apparatus utilizing resistance bands or elastic restraint straps are those that utilize either a waist belt or various harnesses with mating clips that are attached to a body of a user to establish anchor points, wherein elastic cords are attached to the mating clips and then connected to various straps or harnesses placed around various parts of the user's body, such as an elbow, arm, foot, thigh, etc. An example of such an exercise device is disclosed in U.S. Pat. No. 7,608,026 to Nicassio, entitled Device for Strengthening, Training, and Rehabilitating Isolated Muscle Groups Using Elastic Resistance Elements. A similar type of exercise apparatus that is directed a specific physical activity is disclosed in U.S. Pat. No. 7,314,437 to Frappier, entitled Training Harness for Athletic Hitting and Swinging Skills.

As these examples indicate, many of these exercise apparatus require additional elements that may render the exercise apparatus more cumbersome and thus less useful in practice as well as more expensive to produce. Moreover, an exercise apparatus may be usable only for running, walking, or the like, while another exercise apparatus may be designed for a different physical activity, such as hitting or swinging movements in baseball, softball, or golf, and may require additional elements making the exercise apparatus even more cumbersome and expensive to produce. In other words, an exercise apparatus should be able to be utilized by a user in as many different physical activities as practicable.

In view of the foregoing, there is an ongoing need for an exercise device that utilizes resistance bands or elastic restraint straps that is unitary and self-contained in that it does not require additional elements or parts. It should also be easy and inexpensive to produce each such device so that each and every potential user will have an exercise device that exactly matches his or her present physical characteristics and capabilities and meets the needs of their intended training program. It would also be advantageous if the exercise device would be capable of being used in the performance of or training in numerous physical activities other than being limited simply to running, walking, or cycling.

SUMMARY

To address the foregoing problems, in whole or in part, and/or other problems that may have been observed by persons skilled in the art, the present disclosure provides a unitary exercise device comprising a plurality of resistance bands and/or elastic restraint straps to generate simultaneous counter-balancing tensions to the large muscle groups such as the core muscles and legs of a user while the user is undergoing various physical activities.

An exercise device in accordance with the invention is unitary and self-contained; that is, the exercise device is capable of being used by a user without any additional equipment or accessories and is customized and produced specifically for each user individually. Thus, there is "no one size fits all," although there may be small, medium, and large sizes of the exercise device such that each fits a relatively large group of users.

An exercise device in accordance with the invention comprises the following: (a) an elastic waist loop or belt; (b) an elastic left thigh loop; (c) an elastic right thigh loop (d) an elastic left rear strap having a first end and a second end; (e) an elastic right rear strap having a first end and a second end; (f) an elastic left front strap having a first end and a second end; and (g) an elastic right front strap having a first end and a second end. All of the elastic loops and straps in an assembled exercise device may be sewn together where necessary (with bonded nylon or bonded polyester threads) or heat fused together.

In assembling the exercise device, the first ends of the elastic left rear strap and the elastic right rear strap may be anchored together and connected at the middle of the back of the elastic waist loop and then the second end of the elastic left rear strap may be connected to approximately the middle of the rear of the left thigh loop and the second end of the elastic right rear strap may be connected to approximately the middle of the rear of right thigh loop. To complete the assembly, the first end of the elastic left front strap may be connected to the front of the elastic waist loop, slightly offset to left of center, and the first end of the elastic right front strap may be connected to the front of right thigh loop, slightly offset to right of center. Likewise, the second end of the elastic left front strap may be connected to approximately the middle of the rear of left thigh loop and the second end of the elastic right front strap may be connected to approximately the middle of the front of the right thigh loop.

As for the material used for the elastic waist loop, the elastic left and right thigh loops, and the left and right rear and front straps, there are many types of material available from online wholesalers, such as, for example. DirecTex located in Commerce. California. The material may take the form of webbing, cord, or bungee. Elastic webbing may be made from nylon, polypropylene, or polyester and is available in widths that can range from ⅜" to 4". Elastic webbing may be braided, knitted, or woven, and one wholesaler recommends woven elastic for waistbands because woven elastic retains its width when stretched. As for the elastic straps, nylon and polypropylene webbing each have different weights as well as different widths and accordingly the exercise device can be produced with the desired resistive force by varying the thickness, weight, length, or width of the webbing. Industrial sewing thread is also available to provide the required strength for the sewn connections of the final exercise device.

Once the desired webbing is selected, an exercise device can be produced as a unitary exercise device that can be worn over athletic wear or under, the latter being useful when exercising outdoors or in inclement weather. In other embodiments, the exercise device can be integrated into athletic wear; as an example, the waistband may be incorporated into the waistband of a pair of running shorts, with the left and right thigh loops sewn into the left and right pant legs, respectively, of the running shorts.

A method of using the exercise device in a particular physical activity, which may be sprinting or jogging, swinging a golf club or throwing a baseball, or even beginning physical therapy by walking, is also disclosed. Obviously, a serious experienced user in a particular physical activity may likely devise their own exercise program, perhaps with the help of a professional trainer. However, for the average user, whether for a recreational activity or rehabilitation, there are certain principles that may be applicable to utilization of a unitary exercise device in accordance with the invention. An object of the invention, in general, is to help train a user to move his or her body, e.g., walk or run, faster than he or she normally does so that eventually he or she will be able to eventually run or move faster without the unitary exercise device. As for other physical activities, such as swinging a golf club or a tennis racket, the desired improvement may be a faster speed of a golf ball struck from the head of the golf club or a tennis ball from the head of the tennis racquet.

In general, methods and techniques of utilizing a unitary exercise device may incorporate techniques borrowed from high-intensity resistance or interval training, one of which is that training with a unitary exercise device may be three times a week with alternative days of training without the unitary exercise device or no training at all. In other words, training with a unitary exercise device too hard and too often may slow down results and lead to injuries.

To avoid this, methods and techniques of utilizing a unitary exercise in accordance with the invention device may include measuring the metrics of the performance of a physical activity. For example, a runner or bicycle rider wearing a unitary exercise device generally just needs to measure his time over a specified course and compare times with the unitary exercise device to times without the unitary exercise device. For more complex physical activities, such as hitting a golf ball, the physical activity is more complex and there are more metrics that can be measured. An example of an aid in determining these metrics is the Swing-Caddy SC300i Launch Monitor, which can measure the carry/total distance, smash factor, launch angle, swing speed, apex (maximum height), and ball speed of a driven golf ball. The Launch Monitor is set up near the golf ball and sends the measurement data to an app on the user's cell phone. For other sports involving striking a ball or puck, another device that is available to measure ball speed is the Pocket Radar™ Ball Coach Speed Training Tool and Radar Gun.

Other devices, systems, methods, features, and advantages of the invention will be or will become apparent to one with skill in the art upon examination of the following figures and detailed description. It is intended that all such additional systems, methods, features, and advantages be included within this description, be within the scope of the invention, and be protected by the accompanying claims.

BRIEF DESCRIPTION OF THE FIGURES

The invention may be better understood by referring to the following figure(s). The components in the figures are not necessarily to scale, emphasis instead being placed upon illustrating the principles of the invention. In the figures, like reference numerals designate corresponding parts throughout the different views.

FIG. 5C shows a schematic sketch of a right-side perspective view of the user shown in FIG. 6A after completion of his downswing and completing his follow through.

DETAILED DESCRIPTION

In the following description of the preferred and various alternative embodiments, reference is made to the accompanying drawings that form a part hereof, and which is shown by way of illustration a specific embodiment in which the invention may be practiced. It is to be understood that other embodiments may be utilized, and various structural changes may be made without departing from the spirit and scope of this invention.

Figure 1B:
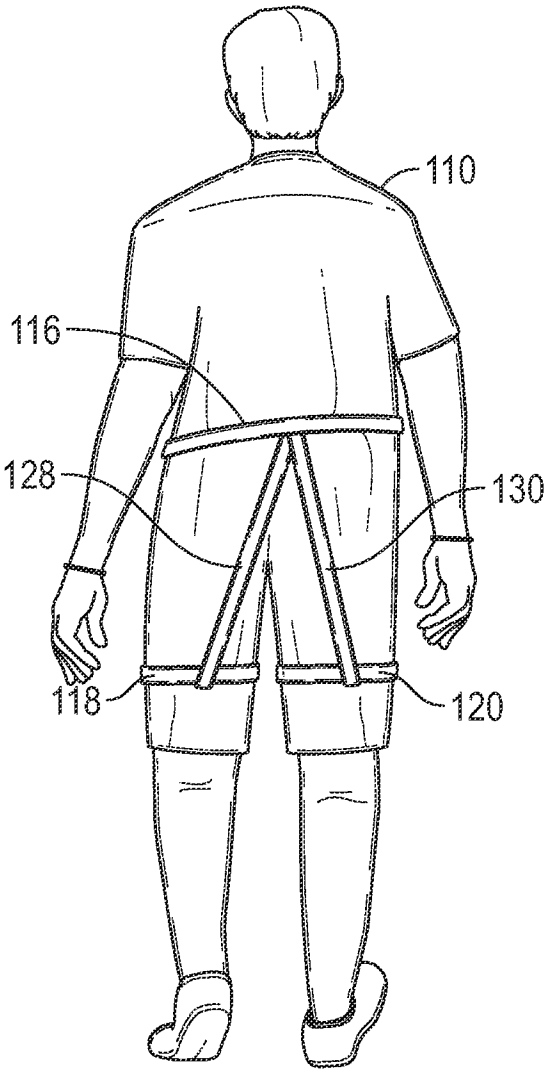
FIG. 1B shows a rear perspective view of an example of an implementation of a unitary exercise device in accordance with the invention worn by a user as shown in FIG. 1A.
Figure 1A:
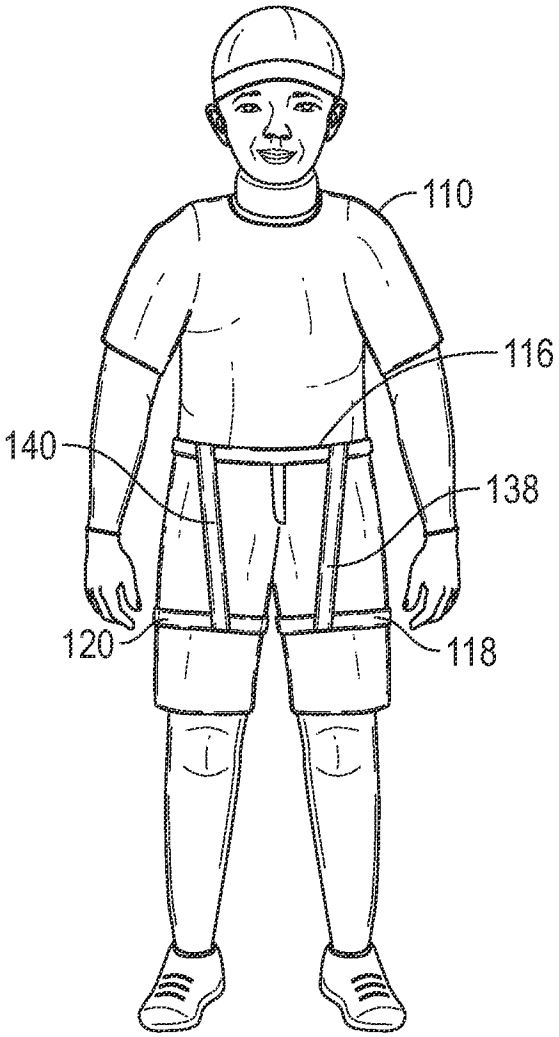
FIG. 1A shows a front perspective view of an example of an implementation of a unitary exercise device in accordance with the invention worn by a user ready to begin physical training.

As shown in FIGS. 1A and 1B, a unitary exercise device, generally designated by the reference character 100, worn by a user generally designated by the reference character 110, wherein a front and a rear view, respectively, of the user is shown. The unitary exercise device 100 comprises the following components: (a) an elastic waist loop 116; (b) an elastic left thigh loop 118; (c) an elastic right thigh loop 120; (d) an elastic left rear strap having a first end and a second end 128; (e) an elastic right rear strap having a first end and a second end 130; (f) an elastic left front strap having a first end and a second end 138; and (g) an elastic right front strap having a first end and a second end 140.

All of the elastic loops and straps of the assembled exercise device of FIGS. 1A and 1B have been sewn together at the appropriate contact points (not shown) with industrial sewing thread, which may be nylon or polyester, where bonded polyester is advisable for applications involving high UV, severe weather, or salt water. An example of a common stitching pattern is the "Box-X stitch," which should be sufficient for most embodiments of the unitary exercise device. As noted earlier, each unitary exercise device is tailor-made for a particular user and should fit snugly but not tightly on the user, with the waist loop positioned basically around the waist of the user, generally, where a belt would be worn. The thigh loops can be positioned approximately one and one-half to two inches above the knees of the user. If the user wishes to lessen the tension provided by the rear and front straps, the thigh loops can be repositioned higher up the legs of the user. In general, when wearing the unitary exercise device, the user of FIGS. 1A and 1B should be aware of when and where the tension will be generated by the rear and front straps when exercising with the unitary exercise device, but the unitary exercise device should remain firmly and comfortably in place on the body of the user.

Figure 2B:
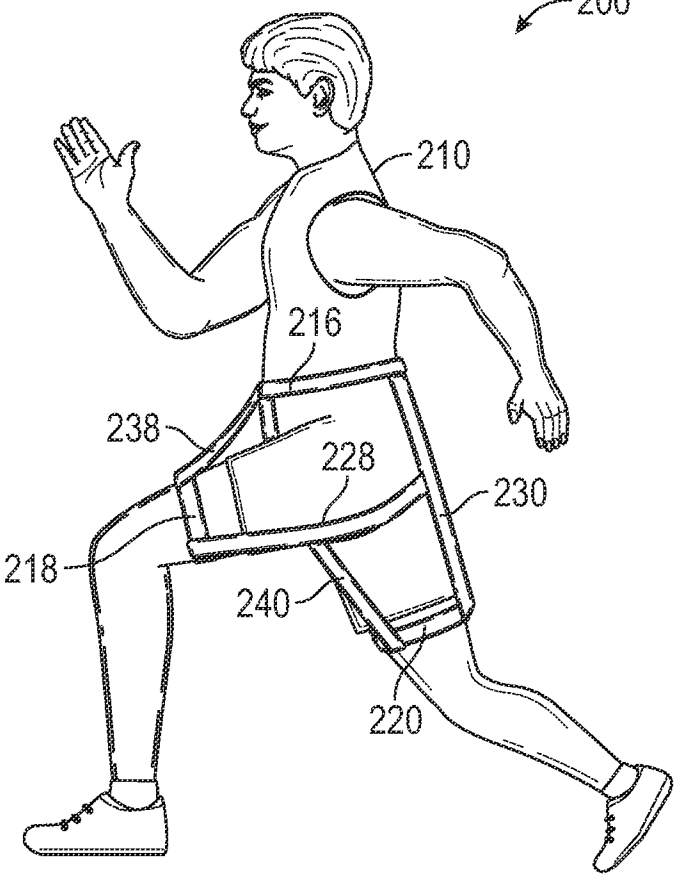
FIG. 2B shows a left side perspective view of the example of an implementation of a unitary exercise device in accordance with the invention worn by a user as shown in FIG. 2A.
Figure 2A:
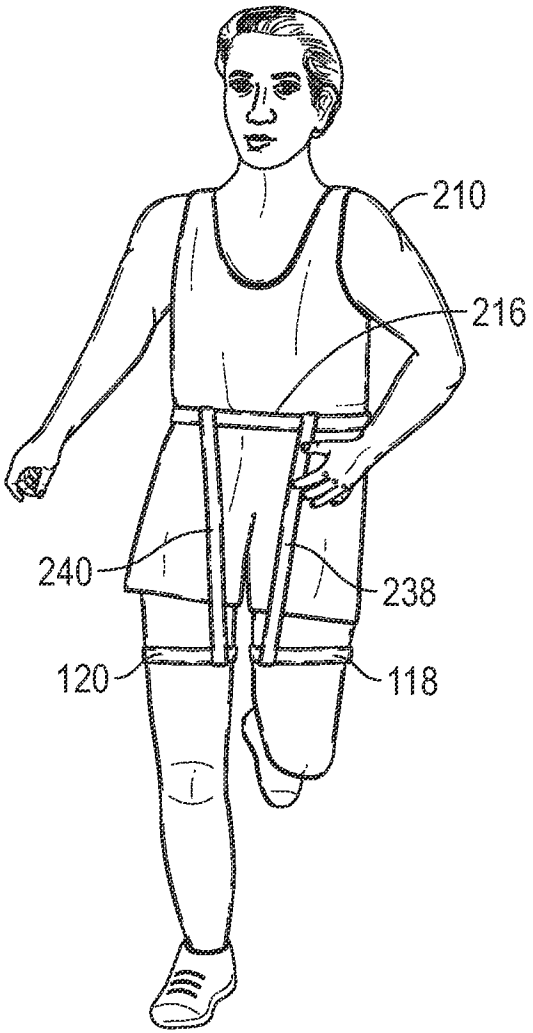
FIG. 2A shows a front perspective view of another example of an implementation of a unitary exercise device in accordance with the invention worn by a user while running or sprinting.

Turning to FIGS. 2A and 2B, a front and left side perspective view, respectively, of the user 210 while running while wearing the unitary exercise device 200 is shown. In FIG. 2B, as the left leg of the user 210 strides forward, tension is built up and stored in the elastic left rear strap 228, while at the same at the same time, a previously stored counter-balancing tension is dissipated from the elastic left front strap 230. Meanwhile, on the right side of the user 210, a similar process takes place, as the right leg of the user 12 strides forward as the left leg of the user 12 retracts.

The elastic left and right rear and front straps of the unitary exercise device 100 provide counter-balancing resistive forces to the front and rear of the left and right legs of the user 12 via the elastic left thigh loop 18 the elastic right thigh loop 20, respectively. This results in a bias toward a faster rate of movement of the legs of a user when performing the exercise, in this instance, running, in a controlled, repetitive manner over an extended period of time. That is, the unitary exercise device 100 is used as a type of high-intensity resistance interval training device, in order to improve speed, endurance, and stamina while subsequently running without the assistance of the unitary exercise device.

That is, the unitary exercise device 100 is designed to train the user to move faster in performing a particular physical activity using counter-balancing resistance assistance, which could be characterized as utilizing rebound energy or the trampoline effect to make the user perform faster than otherwise when training. Another method of high-intensity interval training is downhill running, which forces the user's body to move faster rate than it otherwise could do on its own. The disadvantage of downhill running is that this type of running is more prone to causing injuries because there is a tendency for the user to run too fast. In contrast, using the unitary exercise device allows the user to utilize the resistance forces in more controlled manner that is more efficient and safer. Once the user removes the unitary exercise device muscle memory enables the user to run faster than previously.

Figure 3:
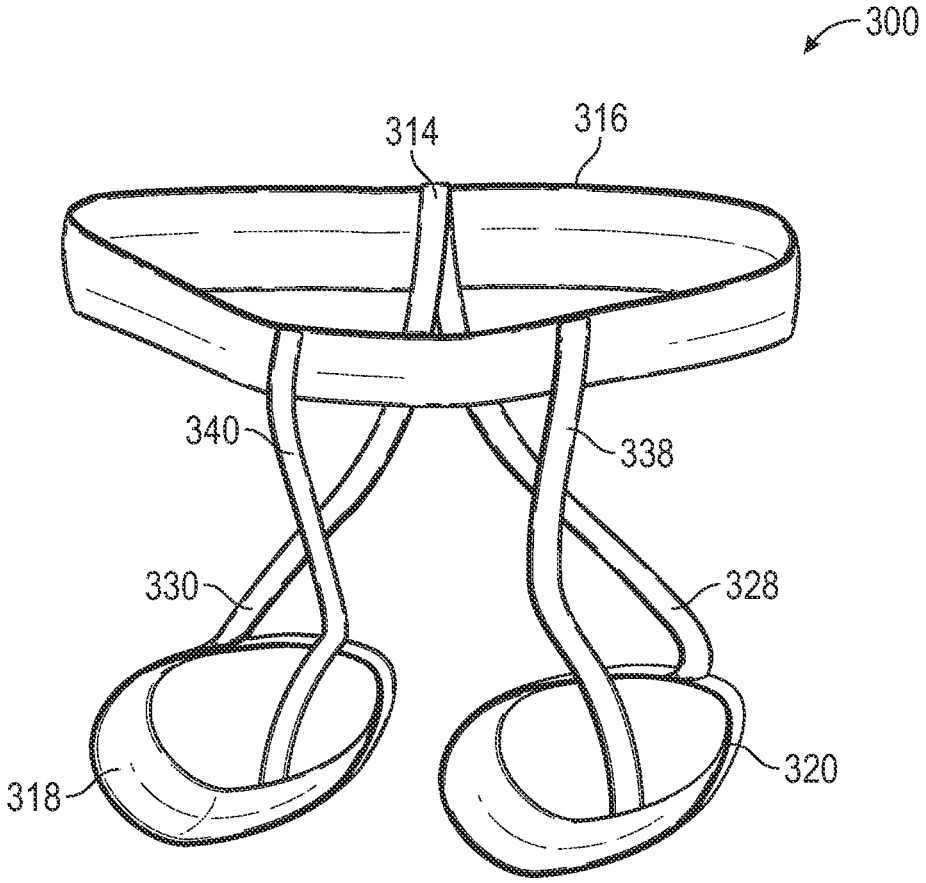
FIG. 3 shows a front perspective view of another example of an implementation of a fully assembled unitary exercise device in accordance with the invention wherein all the components of the unitary exercise device are attached to each other by industrial sewing thread (not shown).

FIG. 3 shows a front perspective view of another example of an implementation of a fully assembled unitary exercise device 300 in accordance with the invention wherein all the components of the unitary exercise device are attached to each other by industrial sewing threads (not shown). The unitary exercise device 300 comprises a waist loop 316, which may consist of a woven elastic nylon or polypropylene strap, having a length equal to the circumference of the waist of the intended user, together an additional 1-2" such that the ends of the waist strap can be sewn or heat-fused together. Once the waist loop 316 is formed, the first ends of the left rear strap 328 and the right rear strap 330 are attached together and then both first ends are attached to the inside of waist loop 316 in the center at the inside rear of waist loop 316, at attachment point 314. The second ends of the left rear strap 328 and the right rear strap 330 are each attached on the outside at the center of the left thigh loop 318 and on the outside at the center of the right thigh loop 320, respectively.

Figure 4:
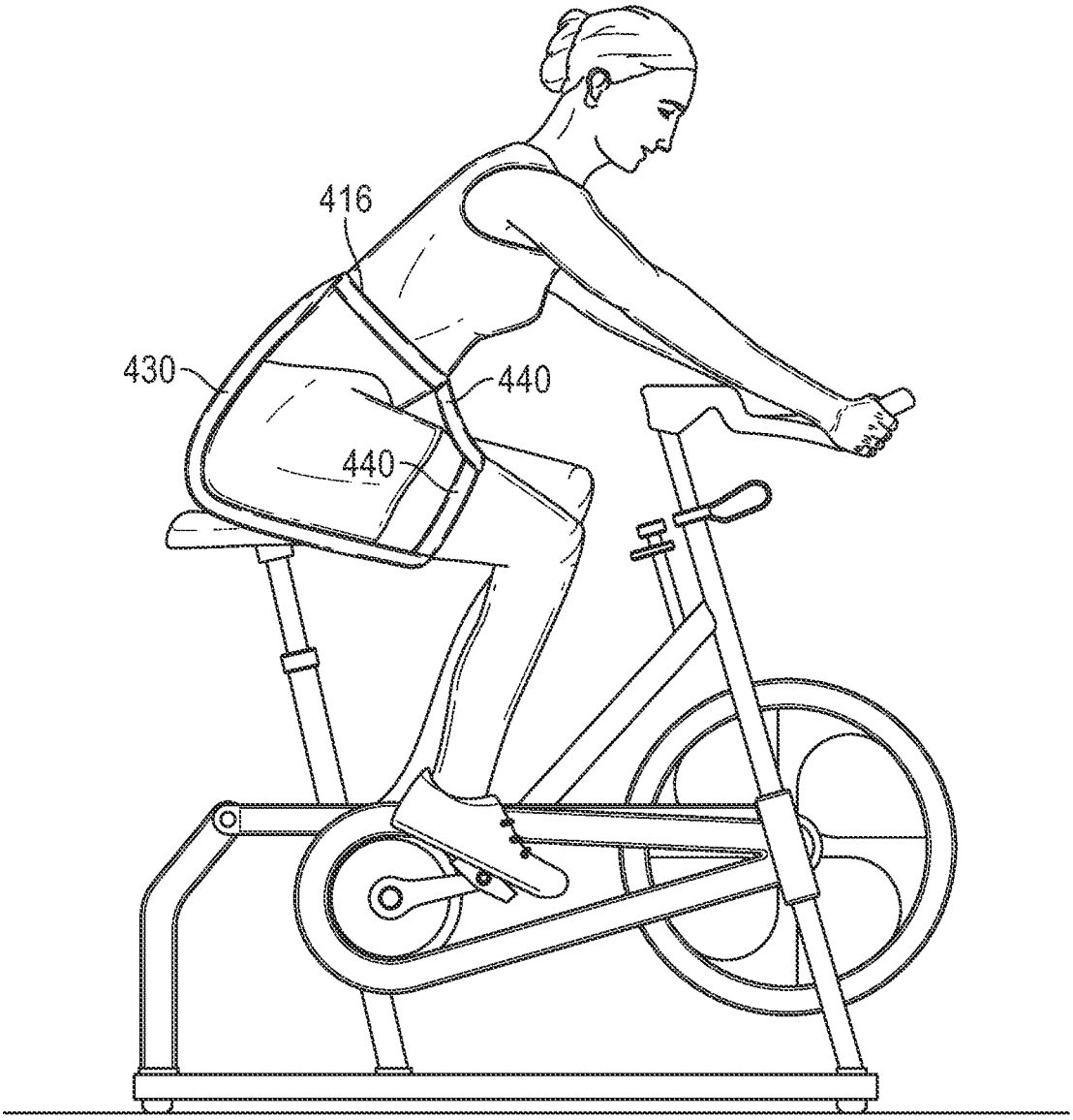
FIG. 4 shows a front perspective view of another example of an implementation of a unitary exercise device in accordance with the invention worn by a user while riding a stationary exercise bicycle with the unitary exercise device worn on the outside of the user's clothing.

FIG. 4 shows a right-side perspective view of another example of an implementation of a unitary exercise device in accordance with the invention worn by a user while riding a stationary exercise bicycle with the unitary exercise device 400 worn on the outside of the user's clothing. In this physical activity, the unitary exercise device operates on the legs of the user in a fashion similar to that of a runner or walker as shown in FIGS. 2A and 2B. What his example illustrates, however, is that a unitary exercise device in accordance with the invention can be used with other exercise equipment, such as a bicycle or treadmill, without any additional equipment or accessories other than the unitary exercise itself.

Figure 5A:
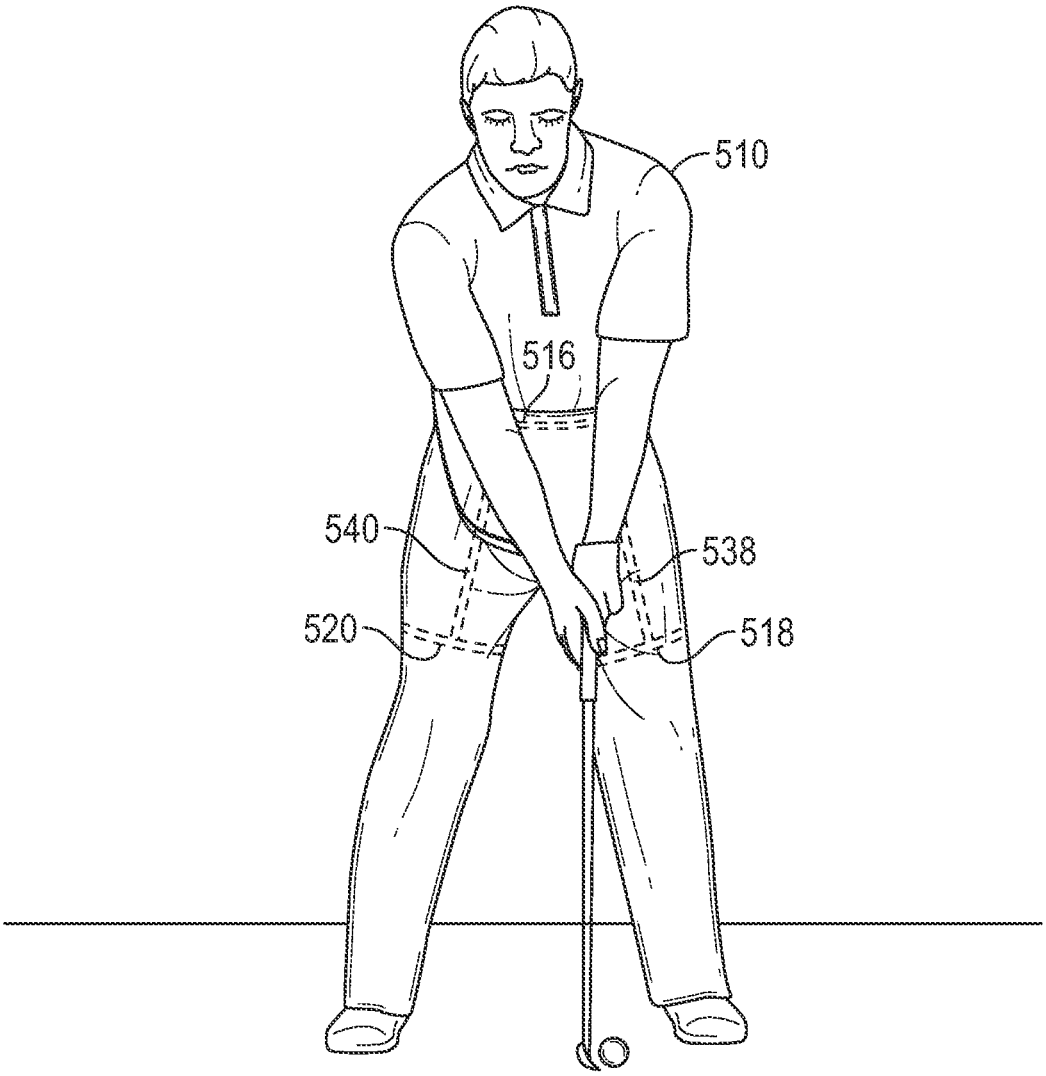
FIG. 5A shows a schematic sketch of a front perspective view of another example of an implementation of a unitary exercise device in accordance with the invention worn by a user while holding a golf club while addressing a golf ball, with the unitary exercise device worn on the inside of the user's clothing and shown in dashed lines.

FIG. 5A shows a schematic sketch of a front perspective view of another example of an implementation of a unitary exercise device in accordance with the invention worn by a user while holding a golf club while addressing a golf ball, with the unitary exercise device worn on the inside of the user's clothing and shown in dashed lines. In this view, the user is in a neutral position and there is no tension on the left and right rear and front elastic straps.

Figure 5B:
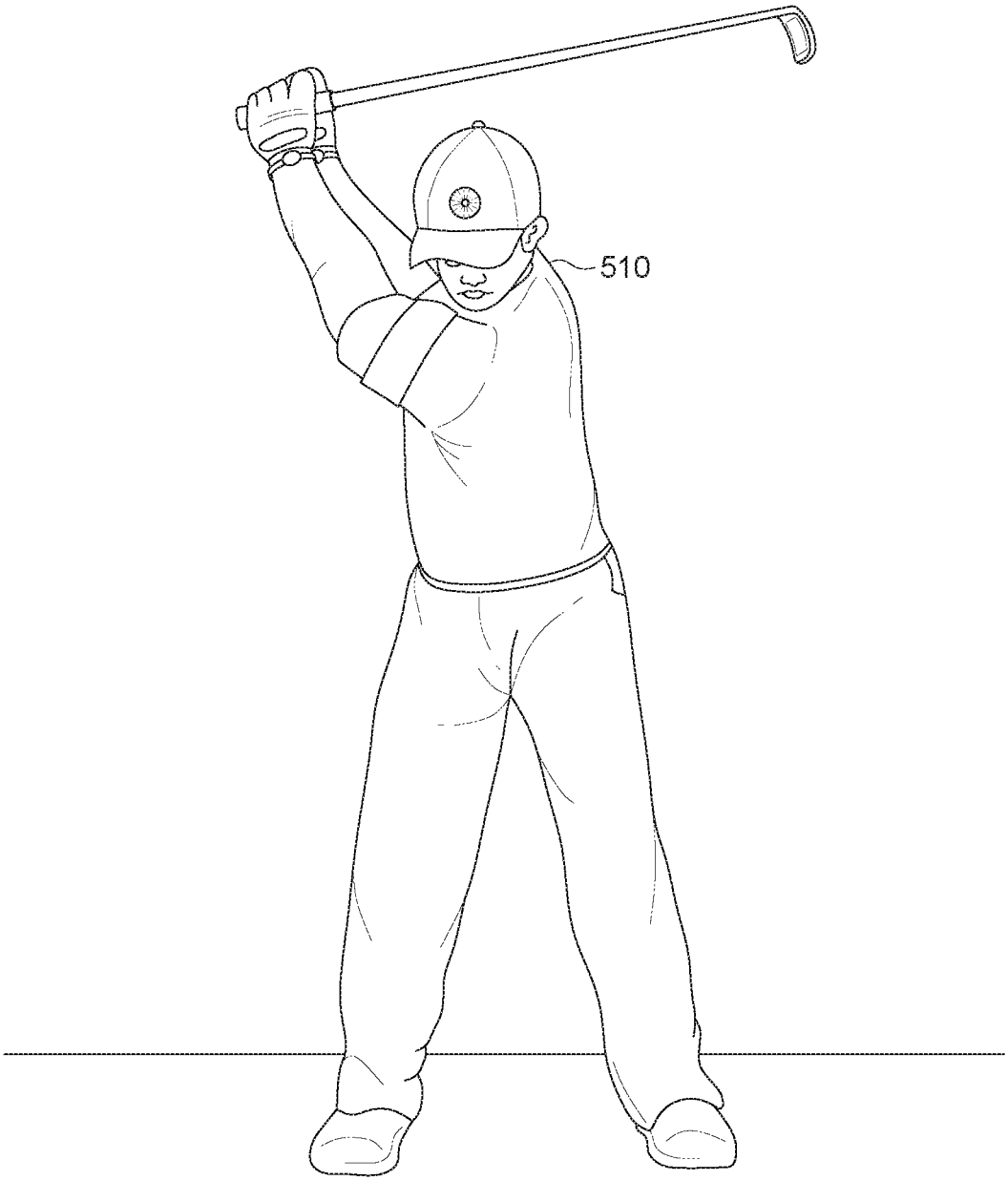
FIG. 5B shows a schematic sketch of a front perspective view of the user shown in FIG. 6A after completion of his backswing and prior to initiating his downswing.

FIG. 5B shows a schematic sketch of a front perspective view of the user shown in FIG. 6A after completion of his backswing and prior to initiating his downswing. As the user (who is right handed) begins his backswing, there is a greater build-up of tension in the core muscles and leg on the left side of the user as he moves from the neutral position to the completion of the backswing.

Figure 5C:
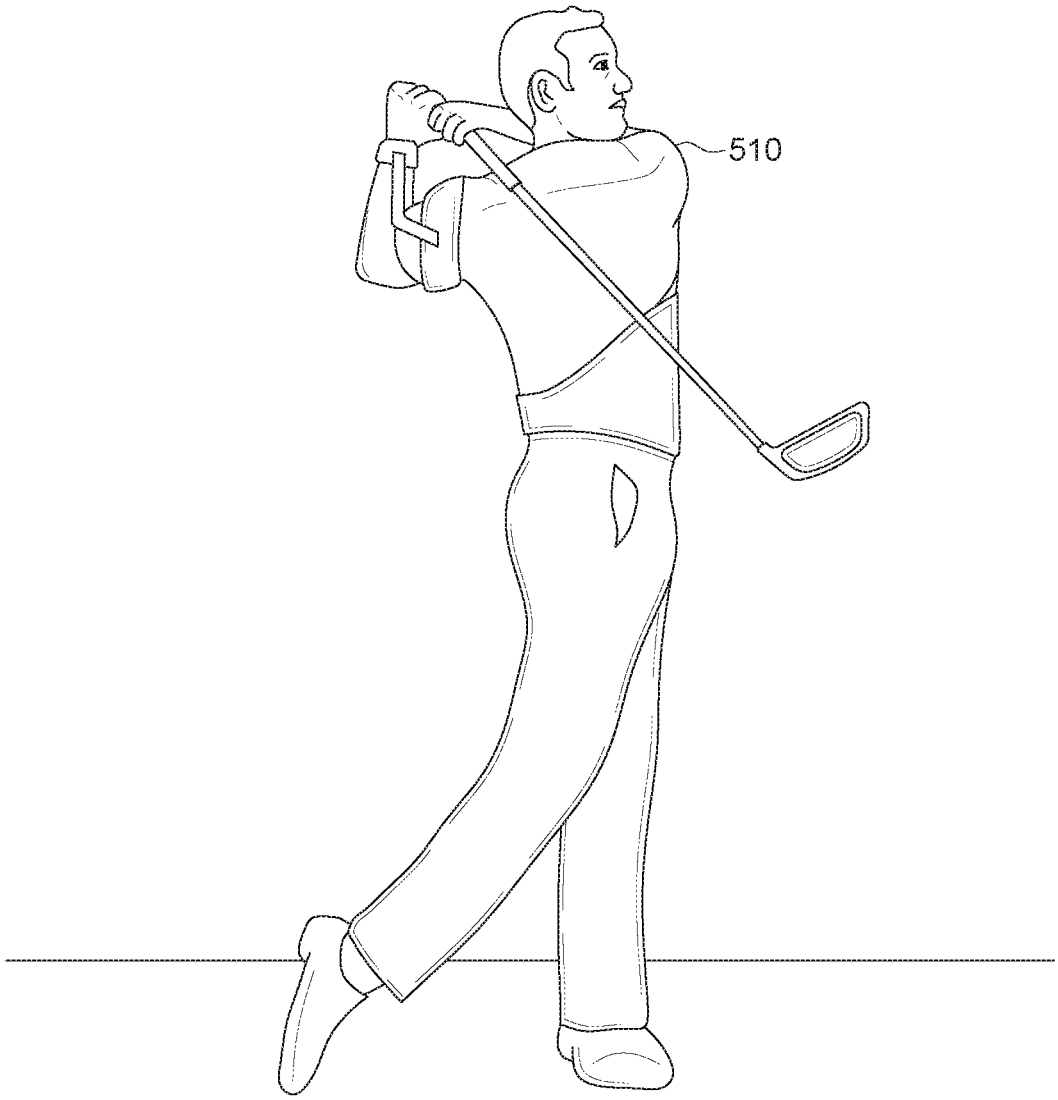

FIG. 5C shows a schematic sketch of a right-side perspective view of the user shown in FIG. 5B after initiating his downswing and rotating his hips thereby increasing tension on his right side while decreasing on his left side where the swinging movement ends with follow through and maximum tension on the right side of the user's body. Thus the tension applied to the left and right side of the user's core and leg muscles trains these muscles to move faster and with more power.

Figure 6:
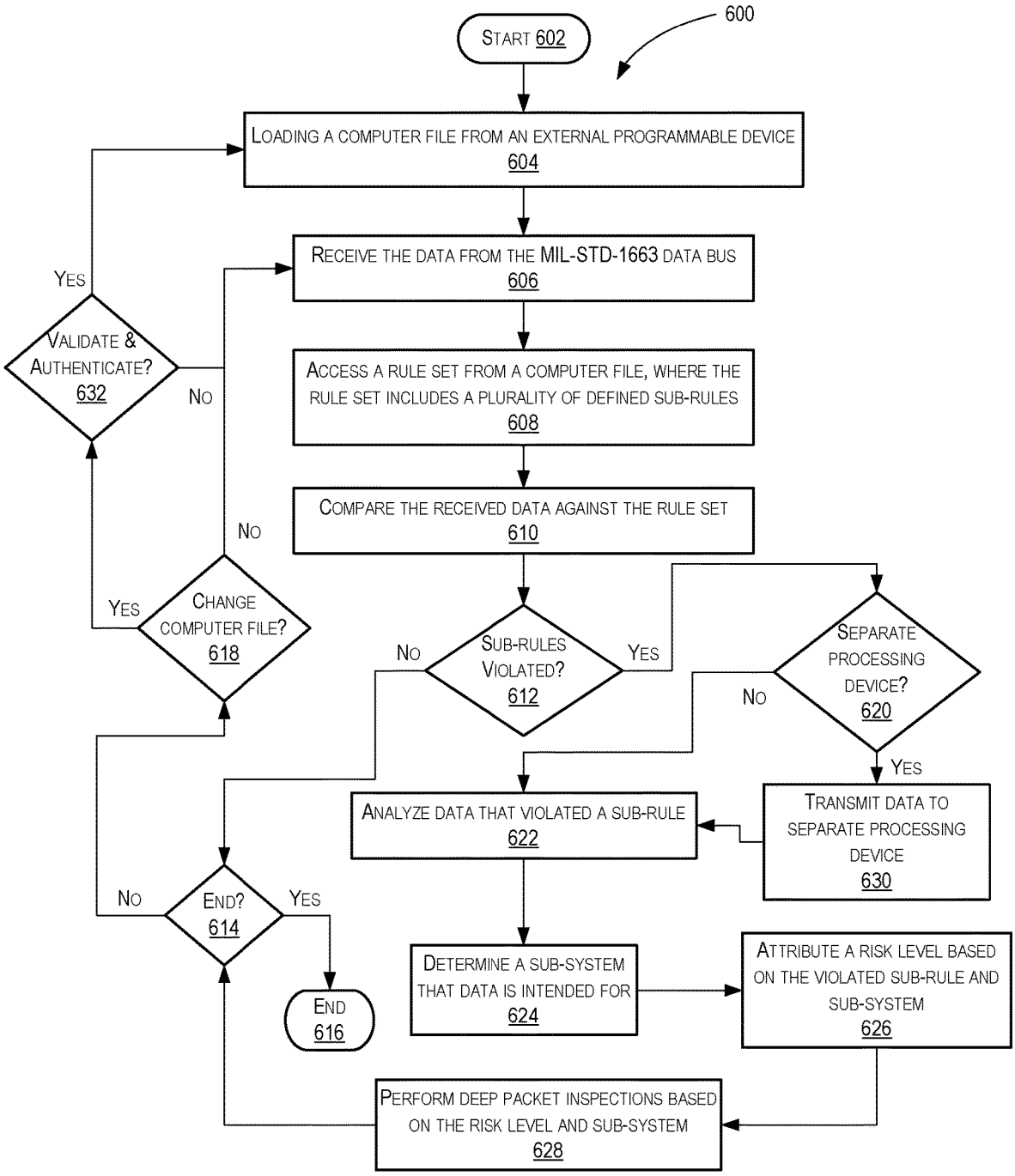
FIG. 6 shows a block diagram of a method of utilizing a unitary exercise device in accordance with the invention worn by a user to perform training of a particular physical activity.

Turning to FIG. 6, a block diagram of a method of utilizing a unitary exercise device in accordance with the invention worn by a user to perform training of a particular physical activity is shown. The method starts in step 602, and in step 604 the user puts on his unitary exercise device and determines if the unitary exercise device fits snugly and comfortably with the desired tension in the left and right front and rear straps. In decision step 606, if the user determines that his unitary exercise device needs adjustment, he then proceeds to step 608 where any necessary adjustments are made after which the user returns to decision step 606. These steps are necessary because each unitary exercise device must be properly fitted to each individual user for the most effective use of the exercise device.

Once the user is satisfied with his unitary exercise device in decision step 606, the process proceeds to step 610, where the user undergoes training with his selected exercise routine while wearing his unitary exercise device. While performing his exercise routine, the user at the same time is measuring his performance for the exercise routine; for example, for basic running or cycling, the applicable metric typically is just the elapsed time to complete a specific distance. For measuring a golf swing, there is the aforementioned Swing-Caddy, and for crunches and sit-ups, the metric may be simply the number of repetitions performed within a specific time period.

The next step is optional step 612, which merely recommends or suggests that the user not repeatedly exercise using only the unitary exercise device. In step 614, the user undergoes training with his selected exercise routine without wearing his unitary exercise device while at the same time measuring his performance for the exercise routine. In decision step 616, the user looks at the metrics from exercising with and without the unitary exercise device and makes a determination whether to continue with his current exercise program; if so, he continues back to step 610. Otherwise, the process ends at step 618, whereupon the user has several options, such as, for example, modifying his exercise routine or modifying his unitary exercise device. e.g., by increasing the tension of the rear and front elastic straps.

In an example of a user utilizing a unitary exercise device, a week-end type golfer used such a unitary exercise device in practicing his golf swing at a driving range. His practice routine was to hit approximately 50 golf balls while wearing the unitary exercise device in a single practice session. Using a Swing-Caddy Launch Monitor, the user found that his driving distance with a driver improved from approximately 216 yards to approximately 260 yards. As expected, when practice time was reduced, the driving distance decreased to approximately 245 yards.

What is claimed is:

1. A method of a user using a unitary, self-contained exercise device configured to exercise core muscles and legs of the user over a full range of motion in performing various physical activities, the unitary, self-contained exercise device comprising:

an elastic waist loop; an elastic left thigh loop; an elastic right thigh loop;

an elastic left rear strap; an elastic right rear strap; an elastic left front strap; and an elastic right front strap;

wherein the elastic left rear and elastic left front straps and the elastic right rear and elastic right front straps each together provide counter-balancing resistive tensions to all or some portion of the core muscles and legs on the left and the right, respectively, of the user, depending on the physical activity involved, and wherein the elastic loops and straps are attached together;

wherein the elastic waist loop is formed from a length of elastic woven nylon webbing sufficient to fit snugly around the user's waist by attaching both ends of the length of elastic woven nylon webbing together to form a single elastic waist loop;

wherein a first end of the elastic left rear strap and a first end of the elastic right rear strap are attached together; the attached first ends of the elastic left and the elastic right rear straps are attached to an inside of an elastic rear center of the elastic waist loop; a second end of the elastic left rear strap is attached to an outside of the elastic left thigh loop rear top center of the elastic left thigh loop; and a second end of the elastic right rear strap is attached to an outside of a rear top center of the elastic right thigh loop; and wherein a first end of the elastic left front strap is attached to the elastic waist loop off-center in a leftward direction in alignment with a front center of the elastic left thigh loop; a second end of the elastic left front strap is attached to the front center of the elastic left thigh loop; a first end of the elastic right front strap is attached to the elastic waist loop off-center in a rightward direction in alignment with a front center of the elastic right thigh loop; and a second end of the elastic right front strap is attached to an outside front center of the elastic right thigh loop;

the method of using the unitary, self-contained exercise device comprising:

while wearing the unitary, self-contained exercise device, determining if the unitary, self-contained exercise device, as constructed, is properly fitted to the user as to its dimensions and tension in the elastic left and right, rear and front, elastic straps;

the user performing a selected exercise routine without wearing the unitary, self-contained exercise device and measuring selected metrics of such performance;

the user performing the selected exercise routine while wearing the unitary, self-contained exercise device and measuring selected metrics of such performance;

comparing the metrics of the performance using the unitary, self-contained exercise device and the metrics of the performance not using the unitary, self-contained exercise device;

evaluating the effect of utilizing the unitary, self-contained exercise device while performing with the unitary, self-contained exercise device responsive to the comparison of the metrics of the performance using the unitary, self-contained exercise device and the metrics of the performance not using the unitary, self-contained exercise device; and repeating the steps of performing the selected exercise routine while wearing the unitary self-contained exercise device and comparing the metrics of the performance using the unitary, self-contained exercise device and the metrics of the performance not using the unitary, self-contained exercise device.

2. The method of claim 1, wherein the step of determining if the unitary, self-contained exercise device is properly fitted to the user includes adjusting the tension in the elastic left front and rear straps and the elastic right front and rear straps of the unitary self-contained exercise device by moving the elastic left thigh loop and the elastic right thigh loop, respectively, further apart from the left and the right knees of the user, respectively, to decrease tension in the elastic left front and rear straps and the elastic right front and rear straps, respectively, and alternatively, moving the elastic left thigh loop and the elastic right thigh loop, respectively, closer to the left and the right knees, respectively, to increase tension in the elastic left front and rear straps and the elastic right front and rear straps, respectively.

3. The method of claim 1, wherein the selected exercise routine comprises running over a specified course and distance and the selected metrics comprise time and distance of the run.

4. The method of claim 1, wherein the selected exercise routine comprises hitting a golf ball from a tee and the selected metrics comprise carry/total distance, smash factor, launch angle, swing speed, apex (maximum height), and ball speed of the driven golf ball derived from a swing-caddy ball coach speed training tool and radar gun.

5. The method of claim 1, wherein the selected exercise routine is throwing a baseball or a medicine ball and the selected metrics comprise ball speed derived from a radar gun.

6. The method of claim 1, wherein the step of comparing selected metrics includes determining either to end the selected exercise routine or to modify the dimensions and characteristics of the elastic loops and straps of the unitary, self-contained exercise device.

7. The method of claim 1, wherein the step of determining if the unitary, self-contained exercise device is properly fitted to the user as to resistive tensions in the elastic left and right, rear and front, straps includes selecting a thickness, weight, length, and width of the left and right, rear and front, elastic straps to provide the desired resistive tensions to the left and right, respectively, legs of the user.

* * * * *